United States Patent [19]

Meyers

[11] 4,037,769

[45] July 26, 1977

[54] GUIDE ROLLER ASSEMBLY

[75] Inventor: Wheeler W. Meyers, Savona, N.Y.

[73] Assignee: Corning Glass Works, Corning, N.Y.

[21] Appl. No.: 730,990

[22] Filed: Oct. 8, 1976

[51] Int. Cl.[2] ..... B65H 23/02

[52] U.S. Cl. ..... 226/190; 29/119; 29/123; 29/125; 242/71.9; 242/73; 271/240; 226/199

[58] Field of Search ..... 226/199, 196, 190, 174, 226/179; 271/240, 248; 29/119, 123, 125; 242/71.9, 73; 193/35 C, 37

[56] References Cited

U.S. PATENT DOCUMENTS

| | | | |
|---|---|---|---|
| 862,109 | 7/1907 | Roth | 242/73 |
| 2,114,378 | 4/1938 | Gundlach | 29/123 X |
| 2,766,041 | 10/1956 | Teplitz | 226/199 X |

*Primary Examiner*—Bruce H. Stoner, Jr.
*Attorney, Agent, or Firm*—Charles W. Gregg; Burton R. Turner; Clarence R. Patty, Jr.

[57] ABSTRACT

A guide roller assembly rapidly adjustable to accommodate, at different times, lengths of different widths of tape, ribbon or similar material so as to maintain the centers of the widths of such lengths in alignment with a centerline extending about the periphery of the roller of said assembly midway between the ends thereof and during longitudinal movement of each said length over part of the periphery of the roller.

2 Claims, 1 Drawing Figure

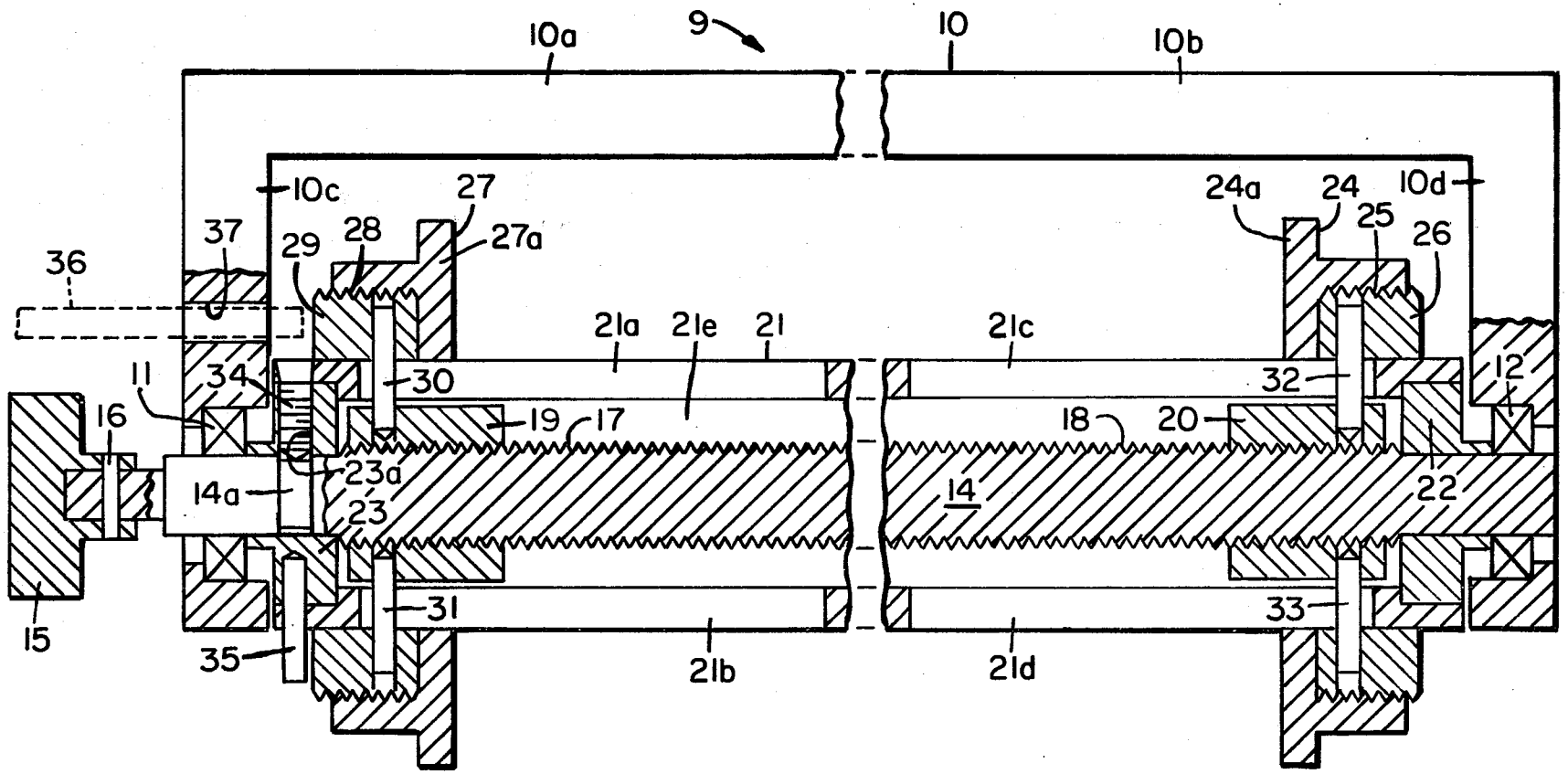
9
10
10a
10b
10c
10d
11
12
14
14a
15
16
17
18
19
20
21
21a
21b
21c
21d
21e
22
23
23a
24
24a
25
26
27
27a
28
29
30
31
32
33
34
35
36
37

GUIDE ROLLER ASSEMBLY

BACKGROUND OF THE INVENTION

There are many types of manufacturing in which there is used lengths or rolls of tape, ribbon or similar material which are intermittently carried or pulled through a path of travel for operations to be performed thereon or thereby and in which it is desired that the material of each said length or roll be maintained in precise alignment widthwise during its movement through said path. For example, in the movement through a selected path of travel of a roll or length of tape or ribbon carrying a series or succession of decals whose transfer films are applied to a surface of each of a series or succession of dish-like articles to provide on said surfaces decorations of a high quality and pleasing appearance, it is necessary that said roll or length of material move through said path with precise widthwise alignment of the material in order to precisely and correspondingly apply each said transfer film to said surface of each of said series or succession of articles. For obvious economic reasons, it is also desirable that a single decal transfer film applying machine can be used, at different times, for different size articles to be decorated and for which purposes decal carrying tapes or ribbons of different widths, but corresponding to the different size articles, are employed. Accordingly, it is an object of the present invention to provide a tape or ribbon guide roller assembly which is readily and rapidly adjustable for accommodating or guiding, at different times, tapes or ribbons of different widths for said precise widthwise alignment thereof in their movement through the assembly and, thereby, through paths of travel such as that mentioned.

It is another object of the present invention to provide an adjustable tape or ribbon guide roller assembly which is rapidly and readily adjustable to assure that, when tapes of different widths are at different times guided thereby, the centerline of the width of each of the tapes or ribbons are precisely aligned with a centerline extending about the periphery of the roller of the assembly midway between the ends of the roller.

Other objects and characteristic features of the invention will become apparent as the description proceeds.

BRIEF SUMMARY OF THE INVENTION

The invention is believed to be adequately summarized in the foregoing abstract of the disclosure and, therefore, for the sake of brevity and to prevent repetition or redundancy to the extent possible, no further summary of the invention will be given nor is any believed necessary.

BRIEF DESCRIPTION OF THE DRAWING

The single drawing FIGURE comprises an elevational view, substantially in cross-section, of one form of a guide roller assembly embodying the invention.

PREFERRED EMBODIMENT OF THE INVENTION

Referring to the drawing in detail, there is shown a ribbon or tape guide roller assembly 9 comprising an inverted generally U-shaped support member 10 including first and second sections 10*a* and 10*b* which may be fixedly held together in any convenient manner, as by a suitable sleeve member not shown, so that first or second arms or inverted uprights 10*c* and 10*d*, respectively, of support 10 are a selected distance from each other. Said arms 10*c* and 10*d* carry or embody roller bearings 11 and 12, respectively, which are disposed precisely opposite each other. First and second ends of a shaft or axle 14 extend into the inner races of said roller bearings 11 and 12, respectively, for support of such shaft and rotation thereof therein. Shaft 14 embodies, extending from near the center of the length thereof to near a first end of the shaft (left hand end thereof viewing the drawing) threads 17 of a first hand, and from near said center of the length of the shaft to near the second end thereof (right hand end thereof viewing the drawing) threads 18 of a second hand opposite to said first hand but otherwise similar to said threads 17. There is shown secured to the left hand end (viewing the drawing) of shaft 14 a manually rotatable knob or wheel 15 which is secured to such end of the shaft as by a suitable pin 16 driven through tightly fitting cooperative holes provided in said shaft end and in a hub part of the knob.

First and second internally and cooperatively threaded sleeve or sleeve members 19 and 20, respectively, are correspondingly screwed onto said threads 17 and 18 provided on shaft 14 near the left and right hand ends, respectively, of the shaft as mentioned above, such sleeves being provided for purposes hereinafter pointed out. A hollow roller 21 is disposed over said shaft 14 and sleeves 19 and 20, in a surrounding relationship therewith, the hollow 21*e* in such roller having a diameter greater than the outside diameter of said sleeves for movement of the sleeves therethrough as hereinafter discussed. Roller 21 also embodies a plurality of longitudinal slots 21*a*, 21*b*, 21*c* and 21*d* extending through the peripheral wall of the roller, said slots 21*a* and 21*b* extending from near the center of the roller to near one or the left hand end thereof when viewing the drawing, and said slots 21*c* and 21*d* extending from near the center of the roller to near the other or the right hand end of the roller when viewing the drawing. The ends of roller 21 have tightly disposed therein, as by press fitting thereof, a pair of bushings 22 and 23 including hub portions which bear against the rims of the inner races of previously mentioned roller bearings 12 and 11, respectively, with the ends of shaft or axle 14 extending snugly but rotatably through the bushings as shown. Thus roller 21 is rotatively supported between said arms or uprights 10*c* and 10*d* of support member 10 with no longitudinal movement of the roller within said support being possible, and a centerline extending about the periphery of roller 21, midway between the ends thereof, is always equidistant from said arms 10*c* and 10*d* for a purpose which will hereinafter become apparent.

A first flanged wheel 27 is snugly and slidably disposed on the left hand end of roller 21 (viewing the drawing) and includes a hub portion 29, provided with threads 28, and an internally threaded flange portion 27*a* which screws onto said threads 28 of portion 29 in a tight fit with such threads for adjustment of said flange portion as discussed hereinafter. Similarly, a second flanged wheel 24 is snugly and slidably disposed on the right hand end of roller 21 and includes a hub portion 26 including threads 25 onto which an internally threaded flange portion 24*a* is screwed in a tight relationship with said threads and for purposes hereinafter discussed. Means are provided for keying each previously mentioned sleeve such as 19 and 20 and the wheels such as 27 and 24, respectively, to roller 21 for rotation therewith, such means comprising a first pair of pins 30 and 31 which extend snugly but slidably through said slots 21*a* and 21*b*, respectively, in roller 21 and into suitably snug holes in hub portion 29 of wheel 27 and in sleeve 19, and a second pair of pins 32 and 33 which extend snugly but slidably through said slots 21*c* and 21*d*, respectively, in roller 21 and into suitably snug holes in hub portion 26 of wheel 24 and in sleeve 20. Thus, longitudinal sliding movement of sleeves 19 and 20 along shaft 14, and imparted to such sleeves by rotation of such shaft without rotation of the sleeves, will impart similar movement to wheels 24 and 27 along the outer periphery of roller 21 as will be readily apparent from the above description.

Shaft 14 further embodies, near the left hand end thereof when viewing the drawing, a peripheral groove 14*a* into which there extends an inner end of a set screw 34 which is screwed into suitable threads provided in a hole 23*a* embodied in bushing 23 and is tightened against shaft 14. Such set screw embodies in the outer end thereof a hex-shaped hole and the set screw provides, by way of said bushing 23, means for releasably keying shaft 14 with roller 21 for rotation of such shaft and roller with each other. Such keying can be relieved or released by inserting an end of a suitable size hex-shaped wrench in said hole in said outer end of set screw 34 and loosening said screw, as is well known in the art. There is also embodied in arm 10*c* of support 10 a hole 37 through which an end of a rod or hex-shaped wrench such as 36 or the like can be inserted to be contacted by a stop pin 35 having one end driven into suitably tight holes provided in bushing 23 and roller 21 and a second end extending a selected distance out of said holes for contacting said end of the rod or wrench such as 36 for purposes discussed hereinafter.

OPERATIONAL EXAMPLE OF THE INVENTION

In employing the guide roller assembly of the invention, support or support member 10 may be affixed in any convenient manner to a machine or apparatus including a path of travel through which a length of tape or ribbon, as from a roll thereof, is to be moved with the centerline of the width of the tape or ribbon, that is a centerline of the tape or ribbon equidistant from both edges thereof, in precise alignment with the centerline of said path of travel as previously mentioned. Initially, however, flange portions 24*a* and 27*a* of wheels 24 and 27 are turned on said tightly fitting threads 25 and 28 on hub portions 26 and 29, respectively, of said wheels until the facing faces or surfaces of said flange portions are each precisely equidistant from the aforesaid centerline extending about the periphery of roller 21 equidistantly from the ends thereof, and support 10 is secured to said machine or apparatus with said centerline of roller 21 aligned with said centerline of the path of travel. The tight fit between said threads 25 and 28 and flange portions 24*a* and 27*a* of wheels 24 and 27 assures thaat the above-mentioned preliminary adjustment of the faces or facing surfaces of said flange portions will be maintained.

Following the above positioning and adjustments, knob 15 on the end of shaft 14 is rotated, set screw 34 having been previously loosened, until pin 35 comes into contact with a rod or wrench such as 36 which has been inserted through hole 37 as shown in the drawing and as mentioned above. Such contact between pin 35 and rod or wrench 36 prevents rotation of wheels 24 and 27, roller 21, and sleeves 19 and 20, and only shaft 14 is then rotated by the rotation of knob 15 and causes sleeve or sleeve members 19 and 20 to move toward each other due to the rotation of threads 17 and 18 on shaft 14 within said sleeves or sleeve members. This movement of sleeves 19 and 20 moves wheels 24 and 27 corespondingly toward each other with the pins such as 30 through 33 moving along their respective slots in roller 21. As is believed apparent, the direction of rotation of knob 15 to cause said movement depends on the respective hands of the threads provided on the left and right hand ends of shaft 14. When the faces or facing surfaces of flange portions 24*a* and 27*a* of wheels 24 and 27 are moved sufficiently that they are spaced from each other a distance equal to the width of the tape or ribbon to be accommodated, set screw 34 is tightened in groove 14*a* of shaft 14 and against such shaft so that roller 21, and wheels 24 and 27 are keyed with shaft 14 for rotation of such parts in unison. Said rod or wrench such as 36 is then removed from hole 37.

As previously mentioned, the above-described rotation of knob 15 and, thereby, of shaft 14 without rotation of roller 21 causes equal movement of wheels 24 and 27 toward each other along such shaft so that said centerline of roller 21 is always equidistant from both of the aforesaid faces of facing surfaces of flange portions 24*a* and 27*a* of said wheels. When the guide roller assembly is to be adjusted for ribbon or tape of a narrower width, the above-described manipulations and the turning of knob 15 are performed until the roller assembly is adjusted for such a narrower width of ribbon or tape. When, of course, a wider width ribbon is to be accommodated by the guide roller assembly, the same manipulations are performed except that knob 15 is rotated or turned in the direction opposite to that in which it was previously turned. The previously discussed rotation of flange portions 24*a* and 27*a* of wheels 24 and 27 on the threads 25 and 28 of the respective hub portions 26 and 29 of such wheels is performed only when the assembly is being preliminarily set up or when the assembly has, for maintenance or repair thereof for example, been moved in relationship with a machine with or on which the assembly is employed, or when such a machine has been moved in relationship to such an assembly employed therewith.

Although there is herein shown and described in detail only one form of apparatus embodying the invention disclosed, it will be understood that such is not to be considered in any way limiting but that various changes and modifications may be made therein within the purview of the appended claims without departing from the spirit and scope thereof.

What is claimed is:

1. A guide roller assemmbly adjustable to guide, at different times, lengths of tape, ribbon or similar material of different widths so that the centerline of the width of each of said lengths may be made to coincide with a centerline extending about the periphery of the roller of said assembly midway between the ends thereof and during longitudinal movement of each said length over said periphery of the roller, such guide roller assembly comprising;

A. a longitudinal hollow roller embodying slots extending from near each end of the roller to near the center thereof and having extending through the length of said hollow a shaft for rotationally supporting said roller, the ends of said shaft extending into rotational bearings disposed in a support member therefor and such shaft having threads of opposite hands extending from near first and second ones of said ends of the shaft to near the center thereof;

B. first and second internally threaded sleeve member screwed corresponding distances onto said threads on said first and second ends, respectively, of said shaft, such sleeve members being longitudinally movable within the hollow of said roller;

C. first and second flanged wheels correspondingly snugly disposed on the outer periphery of said roller between the center and first and second ones of said ends, respectively, of the roller and slidably movable along the length thereof;

D. means extending snugly through said slots in said roller and slidably movable along the length of such slots, such means also extending snugly into associated ones of said wheels and said sleeves for rotation thereof correspondingly with said roller;

E. manually releasable keying means for normally keying said shaft with said roller for rotation thereof in unison; and F. means for imparting rotation only to such shaft when said keying means are manually released and said wheels and roller are held against rotation thereof.

2. A guide roller assembly adjustable to accommodate lengths of tape, ribbon or the like of different widths so that the centerline of the width of each said length may be aligned with a centerline extending about the periphery of the roller of said assembly midway between the ends thereof and during longitudinal movement of each said length over part of said periphery of the roller, said guide roller assembly comprising;

A. a shaft having, extending from near first and second ends to near the center of the length thereof, threads of first and second hands, respectively;

B. first and second internally threaded sleeves screwed corresponding distances onto said threads on said first and second ends, respectively, of said shaft;

C. a hollow roller surrounding said shaft and sleeves and spaced therefrom, such roller embodying slots extending from near the ends to near the center of the length thereof and supporting in each such end a tightly fitting bushing, each such bushing embodying a hole for snugly and rotatively receiving one of the ends of said shaft;

D. a generally U-shaped support member embodying in each of the arms thereof, in alignment with each other, a bearing for receipt of opposite ones of the ends of said shaft for rotation thereof in said bearings;

E. first and second flanged wheels snugly surrounding corresponding portions of the lengths of first and second halves of the outer periphery of said roller and slidable therealong;

F. means for keying each said sleeve and a corresponding one of said wheels with said roller for rotation therewith, each such means extending snugly through one of said slots in said roller and slidably movable along such slot;

G. means on one end of said shaft for rotation thereof; and

H. manually releasable means for keying said shaft with said roller for rotation with each other only when such keying means are in other than their released condition.

* * * * *